US006455476B1

(12) United States Patent
Imai et al.

(10) Patent No.: US 6,455,476 B1
(45) Date of Patent: Sep. 24, 2002

(54) COMPOSITION AND PROCESS FOR LUBRICATED PLASTIC WORKING OF METALS

(75) Inventors: Yasuo Imai, Hiratsuka; Shuji Nagata, Yokohama, both of (JP)

(73) Assignee: Henkel Corporation, Gulph Mills, PA (US)

( * ) Notice: Subject to any disclaimer, the term of this patent is extended or adjusted under 35 U.S.C. 154(b) by 0 days.

(21) Appl. No.: 09/719,065

(22) PCT Filed: Jun. 9, 1999

(86) PCT No.: PCT/US99/12364

§ 371 (c)(1),
(2), (4) Date: Dec. 7, 2000

(87) PCT Pub. No.: WO99/64544

PCT Pub. Date: Dec. 16, 1999

(30) Foreign Application Priority Data

Jun. 9, 1998 (JP) ..... 10-176602

(51) Int. Cl.[7] ..... C10M 125/00; C10M 173/00

(52) U.S. Cl. ..... 508/156; 508/154; 508/157; 508/158; 508/160; 508/181; 72/42; 148/246

(58) Field of Search ..... 508/155, 156, 508/157, 158, 159, 160; 72/42

(56) References Cited

U.S. PATENT DOCUMENTS

| | | | | | |
|---|---|---|---|---|---|
| RE23,184 | E | * | 12/1949 | Whitbeck | 252/18 |
| 2,957,825 | A | * | 10/1960 | Henricks | 252/18 |
| 3,249,538 | A | * | 5/1966 | Freier | 252/18 |
| 3,974,674 | A | * | 8/1976 | Orozco et al. | 72/42 |
| 4,138,348 | A | * | 2/1979 | Grasshoff | 252/42.1 |
| 5,039,435 | A | * | 8/1991 | Hanano | 106/38.22 |
| 5,154,839 | A | * | 10/1992 | Hanano | 252/18 |
| 5,277,831 | A | * | 1/1994 | Hanano | 252/21 |
| 5,279,749 | A | * | 1/1994 | Hanano | 252/21 |
| 5,279,750 | A | * | 1/1994 | Hanano | 252/21 |
| 5,307,660 | A | * | 5/1994 | Stoutenburg | 72/42 |
| 5,547,595 | A | * | 8/1996 | Hacias | 508/156 |
| 6,025,306 | A | * | 2/2000 | Erdemir | 508/125 |
| 6,335,309 | B1 | * | 1/2002 | Takagi et al. | 508/115 |

FOREIGN PATENT DOCUMENTS

| | | |
|---|---|---|
| DE | 4212667 | 1/1993 |
| EP | 0303734 | 2/1989 |
| EP | 0412788 | 2/1991 |
| GB | 1322838 | 7/1973 |
| WO | WO9614947 | 5/1996 |

OTHER PUBLICATIONS

WPAT Abstract JP 92–001798 B—Jan. 14, 1992 (9206).
WPAT Abstract JP 83–030358 B—Jun. 28, 1983 (8329).
WPAT Abstract JP 52–020967 A—Feb. 17, 1977(7713).

* cited by examiner

*Primary Examiner*—Ellen M. McAvoy
(74) *Attorney, Agent, or Firm*—Stephen D. Harper

(57) ABSTRACT

A lubricant composition for the plastic working of metals that does not require a phosphate undercoating, is waterborne, requires only a simple application process of immersion or spraying followed by drying, and provides an excellent lubricating performance comprises synthetic resin, water-soluble inorganic salt, and water. The weight ratio of the content of salt to that of synthetic resin is from 0.25:1 to 9: 1. This composition can also contain liquid and/or solid lubricating agent(s) and an extreme pressure additive.

19 Claims, No Drawings

COMPOSITION AND PROCESS FOR LUBRICATED PLASTIC WORKING OF METALS

FIELD AND BACKGROUND OF THE INVENTION

This invention relates to a highly effective composition for use in the plastic working of metals, for example, iron, steel, titanium, and aluminum. More particularly, this invention relates to a composition of the aforementioned type that forms a strongly-lubricating coating by a simple process in which, before a workpiece is to be subjected to plastic working, the composition is coated on the workpiece by spray or immersion and then dried. The invention also relates to processes for lubricated plastic working of metal, utilizing a lubricant composition according to the invention.

A solid or fluid lubricant is generally used during the plastic working of metals in order to reduce the friction generated by metal to metal contact between the tool and workpiece and thereby prevent seizure and scarring. Lubricated processes for plastic working of metals can be broadly classified into two categories based on the method of use of the lubricant. Into one category fall processes in which lubricants are directly applied to the metal surface, while in the other category a carrier film is first formed on the metal surface by chemical reaction and then the lubricating agent is applied to the carrier film. The former category often utilizes lubricants prepared by the addition of an extreme-pressure additive to a base oil such as a mineral oil, vegetable oil, or synthetic oil. In this case the lubricant is applied to the metal surface and the plastic working operation is then carried out without additional treatment. The former category also can utilize lubricants in which a solid lubricating agent such as a metal soap, graphite, or molybdenum disulfide is dispersed in water along with a binder component. In this case the lubricant is applied to the metal surface and plastic working is carried out after a drying step.

Processes in which lubricants are directly applied to the metal category are frequently used for light plastic working because the lubricants can be applied by simple techniques such as painting and dipping and because they require little or no replenishment, concentration adjustments, or similar "management" of the liquid compositions used in them.

The other category of lubricated process for plastic working of metals requires a chemical conversion coating. In the chemical conversion coating approach, a carrier coating, most often a phosphate type coating, is first formed on the metal surface by chemical reaction and the metal is then treated with a lubricating agent such as a nonreactive soap or a reactive soap such as sodium stearate or calcium stearate. The lubricating coatings formed by this process have a double-layer structure composed of the conversion carrier coating and the metal soap lubricating agent and as a result exhibit a very high resistance to seizure. This feature has resulted in the use of lubricating coatings of this type in a very broad range of plastic working operations, e.g., wire drawing, pipe drawing, and forging.

Phosphate treatments, however, are known to have a number of problems. Thus, phosphate treatments, because they are based on chemical reactions, have required a complex bath management. They have also required a large number of treatment processes—including water and acid rinses—since the lubricating agent is applied after formation of a conversion coating. Phosphate treatments have also been associated with high plant and equipment costs and high operating costs due to the discharge of large amounts of effluent from the conversion coating and the water rinses used during the treatment and due to the necessity for heating in order to optimize the chemical reactions.

In order to address these problems, efforts have been made to raise the performance of the directly-applied-to-the-metal category of lubricated processes to a level equivalent to that obtained by using lubricating coatings afforded by phosphate treatment in order to permit substitution of processes of the former type for the expensive phosphate treatments. These efforts have resulted in the appearance of methods that use oil-based lubricants and methods that use water-based lubricants. Within the realm of the oil-based lubricants, Japanese Published (Examined or Kokoku) Patent Application Number Hei 4-1798 (1,798/1992) discloses a "lubricant for cold working in which a metal soap or solid lubricant is blended into a lubricating oil comprising a mixture of extreme-pressure additive (e.g., chlorinated paraffin, phosphate esters), isobutylene/n-butene copolymer, and animal oil or vegetable oil". However, even though this is a high-performance lubricant, it nevertheless exhibits working characteristics that are somewhat inferior to those of lubricants produced by treatment with a reactive soap after a phosphate conversion coating treatment. Another drawback of this high-performance lubricant is the unpleasant odor produced during plastic working operations that use it.

Water-based lubricants are either used wet without drying (wet method) or are used in the form of a dried coating (dry method). The wet-method water-based lubricants are used by direct application to the tool or workpiece, as in the case of the above-described oil-based lubricants, while the dry-method water-based lubricants are applied by immersion in the treatment bath, just as in the case of the above-described conversion coatings, followed by the production of a solid lubricating coating by evaporation of the water in a drying process. As an example of the wet-method water-based lubricants, Japanese Published (Examined or Kokoku) Patent Application Number Sho 58-30358 (30,358/1983) discloses a "lubricant for the cold- or hot-working of metal tubing comprising the blend of small amounts of dispersant, surfactant, and solid lubricant in a bicarbonate (solids) main component". However, this lubricant has to date not achieved widespread use as a substitute for conversion treatments. An example of the dry-method water-based lubricants is a "lubricant composition comprising a blend of solid lubricant and conversion film-forming agent in a base of water-soluble polymer or its water-based emulsion" that is disclosed in Japanese Laid Open (Kokai or Unexamined) Patent Application Number Sho 52-20967 (20,967/1977). This example notwithstanding, dry-method water-based lubricants equivalent to conversion treatments have not been obtained.

A major object of the present invention is to provide a lubricant composition for the plastic working of metals that does not require a phosphate undercoating, that is waterborne, that requires only a simple application process consisting of immersion or spraying followed by drying, and that, at least in its most preferred embodiments, provides a lubricating performance equivalent to that afforded by formation of a phosphate conversion coating on a metal workpiece and application of a lubricant composition to the conversion coating.

SUMMARY OF THE INVENTION

It has been found that a tough and highly tenacious coating is produced when metal sheet is immersed in an aqueous solution or aqueous dispersion containing synthetic resin and water-soluble inorganic salt and is thereafter dried. The inventors also discovered that a particularly excellent lubricating performance can be imparted to the obtained coating when the aqueous solution or dispersion also contains a lubricating agent, solid lubricant, and/or the like. This invention was achieved based on these discoveries. Embodiments of the invention include liquid working compositions that are suitable for directly treating metal surfaces, dried solid lubricating coatings formed by drying such working compositions and metal workpieces bearing such solid lubricating coatings, concentrate compositions from which working compositions can be formed by dilution with water and/or by mixing with other concentrate compositions, lubricated metal plastic working processes lubricated by a dried composition according to the invention, and processes for preparing metal objects for plastic cold working by providing them with a solid lubricating coating by drying onto the metal objects a liquid coating of a working liquid composition according to the invention.

BRIEF DESCRIPTION OF THE DRAWINGS

FIG. 1 is a cross-sectional view of apparatus used in a backward punch test that was run to test the efficacy of lubricant compositions and processes according to the present invention.

FIGS. 2*a* through 2*d* are projection views of test substrates used in this test before being tested, while FIGS. 3*a* through 3*d* are projection views of the same test substrates after being punched.

DETAILED DESCRIPTION OF THE INVENTION AND ITS PREFERRED EMBODIMENTS

A liquid lubricant composition according to the present invention for use in forming a solid lubricant coating for the plastic working of metals comprises, preferably consists essentially of, or more preferably consists of, water and the following components:

(A) a component of dissolved, dispersed, or both dissolved and dispersed synthetic resin; and (B) a component of water-soluble inorganic salt; and, optionally but preferably, (C) a component of lubricating agent that is not part of either of immediately previously recited components (A) and (B); and, optionally but not necessarily preferably, (D) a component of extreme-pressure additive, components (A) and (B) being present in amounts such that the ratio by weight of component (B) to component (A) is within a range from 0.25:1.00 to 9:1.0.

The synthetic resin (A) used in the lubricant composition according to the present invention is not crucial as long as this resin has the ability to form a coating that has a film strength and adherence sufficient to withstand plastic working operations. Examples of suitable resins are polyvinyl alcohols, polyvinylpyrrolidones, acrylic resins, vinyl acetate resins, epoxy resins, urethane resins, and phenolic resins. These resins can be either water-soluble or water-dispersible, and this particular property is preferably selected based on the intended use. For example, a water-soluble synthetic resin would be selected when the coating is to be washed away after plastic working, while a water-dispersible synthetic resin would be selected when resistance to water is required. The synthetic resin used by the present invention is dissolved or dispersed in the composition according to the present invention. Known surfactants can be used as necessary to effect dispersion. Although ordinarily, for convenience and economy, only a single resin type will be used in a composition according to the invention, two or more types of resins may be mixed and/or two distinct resins of the same type may be mixed in a composition according to the invention.

Polyvinyl alcohols are usually prepared by the hydrolysis of polyvinyl acetates, and the invention can use completely hydrolyzed polyvinyl alcohols as well as polyvinyl alcohols having a degree of hydrolysis down to 50%. For the purposes of the present invention, the polyvinyl alcohol category includes hydrolyzed copolymers of a mixture of ethylene and vinyl acetate in which at least 50 mole percent of the mixture is vinyl acetate and in which sufficient vinyl acetate residues have been hydrolyzed so that at least 50 mole percent of the total of vinyl alcohol, vinyl acetate, and ethylene residues in the polymer are (formally) vinyl alcohol residues. The molecular weight of the polyvinyl alcohol is preferably from 300 to 2,000 as measured by gel permeation chromatography.

Polyvinylpyrrolidone resins suitable for use in the invention can be synthesized by the polymerization of N-vinyl-2-pyrrolidone. For use in this invention, the resulting polymer preferably has a molecular weight from 500 to 1,000 as measured by gel permeation chromatography.

The resins afforded by the polymerization of at least one type of acrylic monomers are examples of acrylic resins suitable for use in the invention. Suitable acrylic monomers are exemplified by the alkyl (C=1 to 8) acrylates and methacrylates, such as methyl acrylate, methyl methacrylate, ethyl acrylate, ethyl methacrylate, isopropyl methacrylate, n-butyl acrylate, n-butyl methacrylate, 2-ethythexyl methacrylate, and octyl acrylate; by lower alkoxy-lower alkyl acrylates and methacrylates such as methoxymethyl acrylate, methoxyethyl acrylate, ethoxymethyl acrylate, ethoxyethyl acrylate, methoxymethyl methacrylate, methoxyethyl methacrylate, ethoxymethyl methacrylate, ethoxyethyl methacrylate, and methoxybutyl acrylate; by lower hydroxyalkyl acrylates and methacrylates such as 2-hydroxyethyl acrylate and methacrylate and 3-hydroxypropyl acrylate and methacrylate; by acrylamide and methacrylamide; by N-methylol-acrylamides and methacrylamides, wherein the methylol group may itself be unsubstituted or may be substituted and in particular may be substituted by lower alkoxy, e.g., N-methylolacrylamide, N-methylolmethacrylamide, N-butoxymethylacrylamide, and N-butoxymethylmethacrylamide; by lower phosphonyloxyalkyl acrylates and methacrylates such as phosphonyloxymethyl acrylate, phosphonyloxyethyl acrylate, phosphonyloxypropyl acrylate, phosphonyloxymethyl methacrylate, phosphonyloxyethyl methacrylate, and phosphonylpropyl methacrylate; and by acrylonitrile, acrylic acid, and methacrylic acid. The invention also encompasses acrylic resins that are copolymers containing at least 30 mole percent of acrylic monomer units selected from the aforementioned acrylic monomers and at least one selection from other ethylenic monomers such as styrene, methylstyrene, vinyl acetate, vinyl chloride, vinyltoluene, and ethylene. The molecular weight of the acrylic resin is preferably from 1,000 to 1,000,000 and more preferably from 100,000 to 600,000, in each case as measured by gel permeation chromatography.

Vinyl acetate resins suitable for use in the invention can be prepared by the polymerization of vinyl acetate. For the purposes of the present description, the term "vinyl acetate resin" encompasses partially hydrolyzed homopolymers of vinyl acetate in which less than 50 mole percent of the initially vinyl acetate residues have been hydrolyzed and vinyl acetate-ethylene copolymers containing at least 50 mole percent of vinyl acetate residues. The vinyl acetate resin preferably has a molecular weight from 200 to 2,000 as measured by gel permeation chromatography.

Epoxy resins can be exemplified most prominently by the bisphenot-type epoxy resins—and particularly by the bisphenol-A epoxy resins that conform to the general formula:

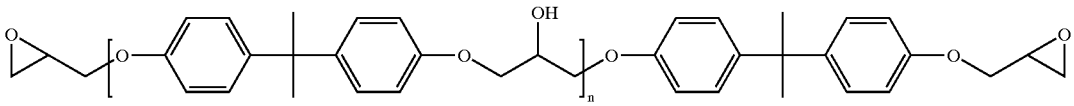

Such resins are afforded by the reaction of epichlorohydrin and a bisphenol and particularly bisphenol-A (the formal systematic name of which is "2,2-bis(4-hydroxyphenyl) propane"). Other suitable epoxy resins can be exemplified by the novolac epoxy resins afforded by the glycidyl etherification of the phenolic hydroxyl moieties in a phenolic novolac resin, the glycidyl esters of aromatic carboxylic acids, and the so-called peracid epoxy resins produced by epoxidation with peracid of the double bond in an ethylenically unsaturated compound. The subject epoxy resins can also be exemplified by the adducts of ethylene oxide or propylene oxide on the resin backbone of any of the above-noted other types of epoxy resins and by the glycidyl ethers of polyhydric alcohols. The bisphenol-A epoxy resins are the most preferred among the preceding examples. The epoxy resin preferably has a molecular weight of 350 to 5,000 as measured by gel permeation chromatography.

Urethane resins are synthetic resins that contain the urethane bond (NHCOO). As a general matter, urethane resins suitable for the present purposes can be prepared by the polyaddition of a polyisocyanate compound bearing at least two isocyanate groups and a polyol bearing at least two active hydrogens. The polyol used in this reaction can be exemplified by polyester polyols and polyether polyols. The polyester polyols can be exemplified by the hydroxyl-terminated polyesters afforded by the reaction, for example, of a low molecular weight polyol and a polybasic acid. The low molecular weight polyol can be, for example, ethylene glycol, diethylene glycol, triethylene glycol, 1,2-propylene glycol, 1,3-propylene glycol, neopentyl glycol, 1,2-butylene glycol, 1,3-butylene glycol, 1,4-butylene glycol, 3-hylpentanediol, hexamethylene glycol, hydrogenated bisphenol-A, trimethylolpropane, and glycerol. The polybasic acid can be, for example, succinic acid, glutaric acid, adipic acid, sebacic acid, phthalic acid, isophthalic acid, terephthalic acid, trimellitic acid, tetrahydrophthalic acid, endomethylenetetrahydrophthalic acid, and hexahydrophthalic acid.

Polyether polyols can be exemplified by the higher ethylene oxide and/or propylene oxide adducts of low molecular weight polyols such as ethylene glycol, diethylene glycol, triethylene glycol, 1,2-propylene glycol, 1,3-propylene glycol, neopentyl glycol, 1,2-butylene glycol, 1,3-butylene glycol, 1,4-butylene glycol, 3-methylpentanediol, hexamethylene glycol, bisphenol-A, hydrogenated bisphenol-A, trimethylolpropane, and glycerol; by polyether polyols such as polyethylene glycol, polypropylene glycol, and polymers of mixed ethylene and propylene glycols; and by polycaprolactone polyols, polyolefin polyols, and polybutadiene polyols.

The polyisocyanate can be, for example, an aliphatic, alicyclic, or aromatic polyisocyanate. Specific examples thereof are tetramethylene diisocyanate, hexamethylene diisocyanate, lysine diisocyanate ester, hydrogenated xylylene dilsocyanate, 1,4-cyclohexylene diisocyanate, 4,4'-dicyclohexylmethane diisocyanate, 2,4'-dicyclohexylmethane diisocyanate, isophorone diisocyanate, 3,3'-dimethoxy-4,4'-biphenylene diisocyanate, 1,5-naphthalene diisocyanate, 1,5-tetrahydronaphthalene diisocyanate, 2,4-tolylene diisocyanate, 2,6-tolylene diisocyanate, 4,4'-diphenylmethane diisocyanate, 2,4'-diphenylmethane diisocyanate, phenylene diisocyanate, xylylene diisocyanate, and tetramethylxylylene diisocyanate.

A urethane resin used in the invention preferably has a molecular weight of 500 to 500,000 when measured by gel permeation chromatography.

Phenolic resins suitable for use in the invention can be obtained by reaction of formaldehyde with at least one phenol selected from, for example, phenol, cresol, and xylenol. The phenolic resin can be a novolac or resole resin. The use of a novolac resin requires the co-use of, for example, hexamethylenetetramine as curing agent. Phenolic resin coatings are cured by the drying process discussed below. The molecular weight of the phenolic resin is not critical.

Commercially available products can of course be used as the resins referenced above. The water-soluble synthetic resins can be acquired already formulated as the aqueous solution, while the water-insoluble synthetic resins can be acquired already formulated as a dispersion in which the resin is dispersed in water using a surfactant that, depending on the particular embodiment, can also be used for dispersion of the lubricating agent, vide infra.

The water-soluble inorganic salt component (B) as described above preferably is homogeneously dissolved in the solution and independently preferably uniformly precipitates with the synthetic resin during drying. Preferred salts exhibiting the desired behavior are one or more selections from the group consisting of sulfate salts, borate salts, molybdate salts, vanadate salts, and tungstate salts. These may be used individually or in combinations of two or more selections. Examples thereof are sodium sulfate, potassium sulfate, sodium borate, sodium tetraborate, potassium borate, potassium tetraborate, ammonium borate, ammonium tetraborate, ammonium molybdate, sodium molybdate, sodium tungstate, and sodium vanadate.

The {water-soluble inorganic salt component (B)}/{synthetic resin component (A) weight ratio}, calculated on a solids basis, must be from 0.25:1 to 9:1. The solid coating will not be hard enough when this weight ratio falls below 0.25:1 and the metal workpiece will as a result suffer from seizure and/or scarring. When this weight ratio exceeds 9:1, the solid lubricating coating formed will suffer from a reduced adherence and a reduced ability to follow the workpiece, during any deformation thereof, which results in facile delamination of the film during the working opera and hence in a reduction in lubrication. This (B)/(A) weight ratio is preferably from 0.3:1 to 8:1 and is more preferably from 0.5:1 to 7:1.

The characteristics of the produced film can be adjusted by varying the {water-soluble inorganic salt}/{water-soluble or -dispersible synthetic resin weight ratio}, and an optimal weight ratio will exist as a function of the severity of the working or rubbing. Thus, the film becomes harder with an increasing proportion of water-soluble inorganic salt, and while this results in a better resistance to loading it also results in a reduced adherence by the film.

As an example, larger additions of the water-soluble inorganic salt are preferred in the case of severe plastic working operations such as closed forging. More specifically, in such cases the (B)/(A) weight ratio, calculated as the solids weight ratio, is preferably from 1.5:1 to 9:1, more preferably from 2:1 to 8:1, and even more preferably from 2:1 to 7:1. in the case, however, of the press working of thin sheet, lower proportions of the water-soluble inorganic salt are preferred, because in such operations it is desirable for the coating to have a better capacity to follow or track the workpiece. In this case the weight ratio under consideration is preferably from 0.25:1 to 2:1 and more preferably from 0.3:1 to 2:1.

The synthetic resin and water-soluble inorganic salt are preferably present in quantities such that the combined amount of the two substances (total solids) is from 1 to 20 percent by weight of a liquid composition according to the invention. This value is more preferably from 1 to 15 percent by weight and even more preferably from 3 to 10 percent by weight.

Among the optional components considered above, lubricating agent component (C) is preferably generally present in the subject composition. The lubricating agent component should be stable in aqueous solution and should not impair the film strength. Examples of this component are metal soaps, waxes, polytetrafluoroethylene, oils, and refractory solid lubricants. The metal soaps can be specifically exemplified by calcium stearate, aluminum stearate, barium stearate, lithium stearate, and zinc stearate; the waxes can be specifically exemplified by polyethylene waxes, polypropylene waxes, carnauba wax, beeswax, and paraffin waxes; and the polytetrafluoroethylene can be specifically exemplified by polytetrafluoroethylenes having a degree of polymerization of about 1 million to 10 million. The oils can be specifically exemplified by vegetable oils, mineral oils, and synthetic oils. The vegetable oils can be exemplified by palm oil, rapeseed oil, and castor oil; the mineral oils can be exemplified by machine oil, turbine oil, and spindle oil; and the synthetic oils can be exemplified by ester oils and silicone oils. Examples of refractory solid lubricants are graphite, molybdenum disulfide, boron nitride, fluorinated graphite, and mica.

Lubricating agent component (C) will generally be present in a composition according to the present invention in dispersed or emulsified form. The lubricating agent concentration in a liquid working composition according to the invention is preferably from 1 to 20 percent by weight, more preferably from 1 to 10 percent by weight, and even more preferably from 2 to 7 percent by weight. A content below 1 percent by weight can result in high film friction and hence in a strong tendency for seizure to occur, while a content in excess of 20 percent by weight may cause the film to suffer from a reduced adherence.

In the case of the invention composition containing components (A) and (B) and lubricating agent and water, a first preferred embodiment thereof contains 0.3 to 10.0 percent by weight (as solids) of urethane resin as component (A), 1.0 to 10.0 percent by weight borate salt as component (B), lubricating agent, and water with a (B)/(A), calculated as the solids weight ratio, in the range from 0.25:1 to 9:1. With regard to the urethane resin component, a content of at least 0.3 percent by weight is preferred in order to avoid a decline in film adherence, while a content no greater than 10.0 percent by weight is preferred in order to avoid a decline in film hardness that would increase the likelihood of seizure. With regard to the borate salt component, a content of at least 1.0 percent by weight is preferred in order to prevent the film from having an inadequate hardness that would result in scarring and seizure of the metal workpiece, while a content no greater than 10.0 percent by weight is preferred in order to avoid a loss in film adherence and extensibility that would result in facile delamination of the film during the working operation and hence in a loss of lubricating performance.

The preferred embodiment considered immediately above can use the same types of lubricating agents and additions thereof as the invention in general.

When a composition according to the invention is intended to be used in severe plastic working operations, the composition preferably contains, as at least part of its content of component (C), a material selected from the group consisting of molybdenum disulfide, graphite, polytetrafluoroethylene, boron nitride, mica, fluorinated graphite, and mixtures of any two or more of molybdenum disulfide, graphite, polytetrafluoroethylene, boron nitride, mica, and fluorinated graphite.[1] This material should be stable in the lubricating solid coating formed and should function to assist the high-toad lubrication performance. The concentration of this material in a liquid composition according to the invention is preferably from 1 to 20 percent by weight, more preferably from 1 to 10 percent by weight, and even more preferably from 1 to 5 percent by weight. Contents below 1 percent by weight risk an inadequate resistance to seizure, while contents in excess of 20 percent by weight risk a reduced adherence.

[1] If, on the other hand, a liquid lubricant composition according to the invention is intended for use only in processes where there is relatively light plastic working, refractory solid lubricants (i.e., those other than polytetrafluoroethylene that are noted in this sentence) are preferably omitted from any component (C) that is present in the lubricant composition according to the invention.

The subject composition preferably also contains an extreme-pressure additive when it is intended to be used in very severe plastic working operations. This extreme-pressure additive should be stable in the lubricating solid coating formed and should exhibit an extreme-pressure activity at the tool-to-metal contact surface produced by the working operation. Examples of such extreme-pressure additives are sulfur-containing, organomolybdenum, phosphorus-containing, and chlorine-containing extreme-pressure additives, such as olefin sulfides, sulfide esters, sulfites, thiocarbonates, chlorinated fatty acids, phosphate esters, phosphite esters, molybdenum dithiocarbamate (hereinafter usually abbreviated as "MoDTC"), molybdenum dithiophosphate (hereinafter usually abbreviated as "MoDTP"), and zinc dithiophosphate (hereinafter usually abbreviated as ZnDTP).

The content of extreme-pressure additive component (D) when this component is present is preferably from 0.5 to 5 percent by weight and more preferably from 1 to 3 percent by weight. A content below 0.5 percent by weight risks an inadequate extreme-pressure activity, while a content in excess of 5 percent by weight risks a reduced film adherence. Independently, the extreme-pressure additive is selected from the group consisting of sulfur-containing extreme-pressure additives, organomolybdenum extreme-pressure additives, phosphorus-containing extreme-pressure additives, and chlorine-containing extreme-pressure additives, and mixtures of any two or more of sulfur-containing extreme-pressure additives, organomolybdenum extreme-pressure additives, phosphorus-containing extreme-pressure additives, and chlorine-containing extreme-pressure additives.

Nonionic, anionic, amphoteric, and cationic surfactants can be used when a surfactant is required to disperse or emulsify the synthetic resin, solid lubricant, other lubricating agent, and/or extreme-pressure additive. The nonionic surfactant is not particularly critical and can be exemplified by polyoxyethylene alkyl ethers, polyoxyalkylene (ethylene and/or propylene) alkylphenyl ethers, the polyoxyethylene alkyl esters composed of polyethylene glycol (or ethylene oxide) and a higher fatty acid such as a $C_{12}$ to $C_{18}$ fatty acid, and the polyoxyethylene sorbitan alkyl esters composed of sorbitan, polyethylene glycol, and a higher fatty acid such as a $C_{12}$ to $C_{18}$ fatty acid. The anionic surfactant is also not particularly critical and can be exemplified by fatty acid salts, the salts of sulfate esters, sulfonate salts, the salts of phosphate esters, and the salts of dithiophosphate esters. The amphoteric surfactant is likewise not particularly critical and can be exemplified by amino acid-type and betaine-type carboxylate salts, sulfate ester salts, sulfonate salts, and phosphate ester salts. The cationic surfactant is again not particularly critical and can be exemplified by aliphatic amine salts and quaternary ammonium salts. These surfactants can be used individually or in combinations of two or more.

The technique for preparing the lubricant composition according to the present invention is not particularly critical as long as the resulting lubricant composition can satisfy the various conditions and specifications given hereinabove. The presence of any of component (C) and/or (D) as described above in a liquid composition according to the invention is preferably effected by mixing this component in the form of its waterborne dispersion or waterborne emulsion with the other components. In one example of the preparation of the subject composition, an aqueous solution or aqueous dispersion of the synthetic resin is added with vigorous stirring to an aqueous solution of the inorganic salt; a dispersion or emulsion of the solid lubricant, other lubricating agent, and/or extreme-pressure additive is prepared using surfactant and water as required; and the two intermediates are then combined with stirring.

Techniques for applying the lubricant composition according to the present invention to the surface of the metal workpiece will now be considered. When the plastic working operation consists of a single stage of plastic working, the preferred technique is to first blend the optional solid lubricant, other lubricating agent, and/or extreme-pressure additive (when one or more of these is used) into the composition comprising components (A) and (B) and water, then to apply the resulting product, which is in liquid form, as a coating to the metal workpiece, and then to dry the liquid coating to produce a solid coating according to the invention on the workpiece before it is worked. When the plastic working operation consists of multiple stages of plastic working, as are encountered in wire drawing and forging, the preferred technique comprises application of the composition comprising components (A) and (B) and water to the metal workpiece, drying to produce a film that functions as a carrier and partial lubricant itself, and carrying out the plastic working operation with the additional application to the carrier film (for example, by dusting) of the optional solid lubricant, other lubricating agent, and/or extreme-pressure additive at each stage of the working operation.

Thus, a lubricant composition according to the present invention preferably additionally contains solid lubricant, other lubricating agent, and/or extreme-pressure additive as necessary when used in particular for the single-stage plastic working of metals, but also as desired in the case of multistage plastic working.

A lubricant composition according to the present invention can be used as the lubricant that is employed during the cold plastic working (e.g., wire drawing, pipe drawing, forging) of metals such as iron, steel, copper, copper alloys, aluminum, aluminum alloys, titanium, and titanium alloys. The shape of the metal is not particularly critical since the invention contemplates the working of not only stock such as bar and block, but also formed articles (gears and shaft toes) after hot forging.

In order to obtain good results, prior to application of the lubricant composition according to the present invention, the surface of the metal workpiece is preferably cleaned by a pretreatment comprising, in the order given, degreasing (an alkaline degreaser can generally be used), a water rinse, an acid rinse (carried out using, for example, hydrochloric acid, in order to remove the oxide scale on the metal and thereby improve film adherence), and a second water rinse. The acid rinse and the ensuing water rinse can be omitted when metal oxide scaling is not present.

The lubricant composition according to the present invention can be applied to the metal workpiece by the usual methods, such as dipping, spraying, and pouring. The application method needs only to provide a thorough coverage of the metal surface with the lubricant composition, and the application time is not otherwise a critical factor. A liquid lubricant composition according to the invention must be dried after its application before it is used to provide lubrication. While drying can be effected by standing at ambient temperature, drying is optimally carried out generally at from 60 to 150 ° C. for 10 to 60 minutes.

The post-coating, post-drying film coating weight afforded by the invention composition is preferably at least 1 $g/m^2$ from the standpoint of preventing seizure, but preferably does not exceed 30 $g/m^2$ based on cost considerations. A more preferred range is from 5 to 20 $g/m^2$, while an even more preferred range is from 8 to 15 $g/m^2$.

The invention and its advantageous effects will be explained more specifically in the following through working examples of the invention and comparative examples.

Examples 1 to 3 and Comparitive Examples 1 and 2

The following pretreatment processes (1) and (2) were carried out on the test specimen prior to application of the lubricant composition for Bowden testing:

(1) Alkaline degreasing: FINECLEANER® 4360 from Nihon Parkerizing Company, Limited, concentration= 20 g/L, temperature=60 ° C., immersion for 10 minutes;

(2) Water rinse: spray with tap water at ambient temperature.

This pretreatment was followed by forced-convection drying.

Lubricant compositions were prepared using the proportions reported in the tables below. Each composition was prepared by dissolving the water-soluble inorganic salt in water followed by dissolution of the phenolic resin with thorough stirring. A cleaned and dried Bowden test specimen (SPC steel sheet, 150 mm×75 mm×1.0 mm) was dipped in the particular lubricant composition for 30 seconds, dried at 100° C. for 30 minutes, and then dusted over its entirety with calcium stearate powder (from Nippon Yushi Kabushiki Kaisha) before being submitted to Bowden testing.

The coating weight in g/m$^2$ was calculated from the weight difference before and after application of the lubricant composition. The Bowden test used a test load of 5 kilograms (this unit being hereinafter usually abbreviated as "kg"), a test temperature of room temperature (i.e., 18–23° C., and a 5 millimeters in diameter steel test sphere. The friction coefficient and number of strokes to seizure (number of sliding strokes until the friction coefficient reached 0.25) was measured in the Bowden test. The average friction coefficient reported in the tables is the average of the friction coefficients measured for the five strokes preceding and the five strokes after the stroke equal to one-half of the number of stokes to seizure.

Examples 4 to 17 and Comparitive Examples 3 to 6

Lubricant compositions were prepared using the proportions reported in the tables below. Each lubricant composition was prepared by dissolving the water-soluble inorganic salt in water followed by the dissolution with thorough stirring of the urethane resin, polyvinyl alcohol, phenolic resin, or acrylic resin. The particular lubricating agent, i.e., polyethylene wax dispersion, calcium stearate dispersion, polytetrafluoroethylene, or palm oil emulsion, as reported in the tables was then added with stirring to give the lubricant composition. The Bowden test specimens (SPC steel sheet, 150 millimeters×75 millimeters×1.0 millimeter), cleaned and dried as described for Examples 1 to 3, were dipped in the particular lubricant composition for 30 seconds and dried at 100° C. for 30 minutes and then submitted to Bowden testing. The Bowden test and pretreatment of the Bowden test specimen were carried out as described for Examples 1 to 3.

In addition to the Bowden test specimens, solid cylinders of commercial spheroidized annealed S45C steel were used as backward punch test specimens in Examples 4–17 and Comparison Examples 3–7. The backward punch test specimens all had diameters of 30 millimeters and each one had a height ranging from 16 to 40 mm in 2 millimeter increments and thus was one of thirteen different lengths, four of which are illustrated in drawing FIGS. 2*a* through 2*d*. These backward punch test specimens were pretreated by the following processes (1) to (4) prior to coating with the lubricant composition:

(1) Alkaline degreasing: FINECLEANER® 4360 from Nihon Parkerizing Company, Limited, concentration=20 g/L, temperature=60° C., immersion for 10 minutes;

(2) Water rinse: spray with tapwater at ambient temperature for 30 seconds;

(3) Acid rinse: hydrochloric acid, concentration=17.5 percent by weight, temperature=room temperature, dipping time=10 minutes;

(4) Water rinse: spray with tapwater at ambient temperature for 30 seconds.

Pretreatment was followed by forced-convection drying. The thus cleaned and dried backward punch test specimens were dipped in each lubricant composition for 30 seconds, then completely dried by holding in a 100 ° C. oven for 30 minutes, and submitted to testing.

The backward punch test used a 200-ton crank press. In the backward punch test procedure, the dies 2 in FIG. 1 were set to bind the circumference of the cylindrical test specimens 1 as illustrated in FIG. 1, and the specimen was then subjected to a downward stroke from a punch 3 also shown in FIG. 1. The punch had a diameter designed to give a 50% cross section reduction of the test specimens 1 and to produce a cup-like molding as shown in FIGS. 3*a* through 3*b*. The lower dead point of the press was adjusted to give a 10 millimeters residual margin at the bottom of the test specimen. The following characteristics also applied to the backward punch test: The dies were SKD11; the punch was HAP40, with an outside diameter of 21.21 millimeters; the punch depths were 12, 16, 20, 24, 28, 32, 36, 40, 44, 48, 52, 56, and 60 millimeters, respectively, for the thirteen sizes of test specimens in order of increasing heights of the test specimens, and the working rate of the punch was 30 strokes/minute. Backward punch testing was run on the test specimens in order of increasing height until damage occurred to the worked surface. The good punch depth was designated as the largest inside height of the test specimen cup at which the inner surface remained undamaged.

Comparitive Example 7

Bowden test specimens and backward punch test specimens as described for Examples 4 to 17 were subjected to conversion treatment and then reactive soap lubrication treatment using the conditions reported in the tables. The resulting test specimens were subjected to Bowden testing and backward punch testing also as described for Examples 4 to 17.

Examples 18 to 34

Lubricant compositions were prepared using the proportions and materials reported in the tables. After following the procedure described for Examples 4 to 17, a refractory solid lubricant or an extreme-pressure additive as specified in the tables was added after the particular solid lubricant or extreme-pressure additive had been preliminarily dispersed into water, using an amount of polyoxyalkylene alkylphenyl ether nonionic surfactant that corresponded to 2 percent of the weight of the solid lubricant or extreme-pressure additive being dispersed.

Application, Bowden testing, and backward punch testing were then carried out as described for Examples 4 to 17.

The results of the various tests described above are reported in the tables below. These results confirm that Examples 1 to 34, which employed lubricant compositions according to the present invention for the plastic working of metals, provided a superior lubricating performance using a simple procedure. In contrast, Comparative Examples 1 to 6, which either did not contain both components required according to the invention or contained these components in ratios to each other outside the range specified for the invention, were all unable to provide both an excellent lubricating performance and simple process features. The phosphate coating produced in Comparative Example 7 did exhibit a lubricating performance equal to that of the present invention, but required a large number of steps and could not be implemented using simple facilities.

The components referenced in Tables 1 to 3 and their abbreviations are defined below, except for those components that have already been noted together with their abbreviations above.

Phenolic resin (molecular weight=500 to 6,000): phenol novolac made water soluble by amination. This component is abbreviated in the tables as PR.

Urethane resin (molecular weight at least 50,000): produced by the polyaddition of polyethylene glycol (molecular weight=1,000) and hexamethylene diisocyanate. This component is abbreviated in the tables as UR.

Acrylic resin: copolymer of acrylic acid, methyl methacrylate, and n-butyl acrylate; molecular weight at least 150,000; surfactant used =polyoxyethylene alkylphenyl ether. This component is abbreviated in the tables as AR.

PVA: polyvinyl alcohol with a molecular weight of 1,000.

PE wax: This was a polyethylene wax emulsion prepared by the emulsion polymerization of ethylene. Molecular weight=16,000 to 20,000. This component is abbreviated in the tables as PEW.

Polytetrafluoroethylene wax: from Sumitomo 3M. This component is abbreviated in the tables as PTFE.

Calcium stearate dispersion: from Chukyo Yushi. This component is abbreviated in the tables as CaStD.

Palm oil emulsion: a dispersion of palm oil using polyoxyalkylene alkylphenyl ether. This component is abbreviated in the tables as PaOE.

Sulfurized vegetable oil: product of Nippon Yushi. The abbreviation for this component in the tables is SVO.

Phosphite ester: product of Sakai Kagaku. The abbreviation for this component in the tables is P3E.

NaW: sodium tungstate

NaMo: sodium molybdate

KTB: potassium tetraborate

NaTB: sodium tetraborate

KV: potassium vanadate

KS: potassium sulfate

CaStP: calcium stearate powder

GP: graphite powder

FGP: fluorinated graphite powder

MDS: molybdenum disulfide powder

The percent by weight reported for each component in the tables is the percent by weight of the identified component itself. Thus, in the case of aqueous dispersions as an example, this value will not include the water and surfactant used for the dispersion.

The preceding description makes it clear that the lubricant composition according to the present invention for application to the plastic working of metals has the ability to form a highly lubricating film through a simple process. This composition also produces only small amounts of wastes and provides a good working environment.

TABLE 1

Examples 1 to 3 and Comparative Examples 1 and 2

| Identifying Numbers | Components: Water-Soluble Inorganic Salt Material | Weight % | Synthetic Resin Material | Weight % | Other Dispersed Component Material | Weight % | Dusted Material | Ratio by Weight of Water-Soluble Inorganic Salt to Synthetic Resin | Coating Weight, g/m$^2$ | Bowden Test Results: Average Friction Coefficient | Number of Strokes to Seizure |
|---|---|---|---|---|---|---|---|---|---|---|---|
| WORKING EXAMPLES | | | | | | | | | | | |
| 1 | NaW | 2 | PR | 4 | — | | CaStP | 0.50 | 8.2 | 0.15 | 625 |
| 2 | NaMo | 4 | PR | 6 | — | | CaStP | 0.67 | 7.1 | 0.13 | 482 |
| 3 | KTB | 4 | PR | 6 | — | | CaStP | 0.67 | 7.0 | 0.13 | 523 |
| COMPARATIVE EXAMPLES | | | | | | | | | | | |
| 1 | NaW | 9.5 | PR | 1 | — | | CaStP | 9.5 | 8.1 | 0.18 | 212 |
| 2 | NaW | 0.5 | PR | 4 | — | | CaStP | 0.13 | 8.7 | 0.15 | 128 |

TABLE 2

Examples 4 to 17 and Comparative Examples 3 to 7

| Identifying Numbers | Components: Water-Soluble Inorganic Salt Material | Weight % | Synthetic Resin Material | Weight % | Other Dispersed Component Material | Weight % | Ratio by Weight of Water-Soluble Inorganic Salt to Synthetic Resin | Coating Weight, g/m$^2$ | Test Results: Bowden Test Average Friction Coefficient | Number of Strokes to Seizure | Backward Punch: Good Punch Depth, Millimeters |
|---|---|---|---|---|---|---|---|---|---|---|---|
| WORKING EXAMPLES | | | | | | | | | | | |
| 4 | NaW | 3 | PR | 1 | PEW | 5 | 3 | 8.7 | 0.08 | 635 | 44 |
| 5 | NaW | 3 | PVA | 1 | PEW | 3 | 3 | 9.1 | 0.09 | 425 | 44 |
| 6 | NaW | 6 | UR | 2 | PEW | 5 | 3 | 11.8 | 0.07 | 823 | 44 |
| 7 | NaMo | 3 | PR | 1 | PEW | 3 | 3 | 9.2 | 0.09 | 740 | 44 |
| 8 | KTB | 3 | PR | 1 | CaStD | 3 | 3 | 10.2 | 0.08 | 735 | 44 |
| 9 | KV | 3 | PR | 1 | CaStD | 5 | 3 | 10.1 | 0.07 | 631 | 44 |

TABLE 2-continued

| Examples 4 to 17 and Comparative Examples 3 to 7 | | | | | | | | | | | |
|---|---|---|---|---|---|---|---|---|---|---|---|
| | Components | | | | | | Ratio by Weight of | | Test Results | | |
| | Water-Soluble Inorganic Salt | | Synthetic Resin | | Other Dispersed Component | | Water-Soluble Inorganic Salt | Coating | Bowden Test | | Backward Punch: |
| Identifying Numbers | Material | Weight % | Material | Weight % | Material | Weight % | to Synthetic Resin | Weight, g/m$^2$ | Average Friction Coefficient | Number of Strokes to Seizure | Good Punch Depth, Millimeters |
| 10 | KS | 3 | AR | 1 | CaStD | 3 | 3 | 9.7 | 0.08 | 688 | 44 |
| 11 | NaTB | 3 | UR | 1 | PEW | 5 | 3 | 9.0 | 0.09 | 688 | 44 |
| 12 | NaTB | 3 | UR | 3 | PEW | 5 | 1 | 12.2 | 0.08 | 823 | 44 |
| 13 | NaTB | 3 | UR | 8 | PEW | 5 | 0.38 | 11.1 | 0.07 | 888 | 44 |
| 14 | NaTB | 2 | UR | 1 | CaStD | 3 | 2 | 8.8 | 0.09 | 510 | 44 |
| 15 | KTB | 3 | UR | 5 | CaStD | 3 | 0.60 | 8.5 | 0.09 | 635 | 44 |
| 16 | KTB | 3 | UR | 1 | PTFE | 5 | 3 | 12.3 | 0.07 | 912 | 44 |
| 17 | KTB | 8 | UR | 1 | PaOE | 3 | 8 | 9.5 | 0.08 | 823 | 44 |
| COMPARATIVE EXAMPLES | | | | | | | | | | | |
| 3 | NaW | 9.5 | PR | 1 | PEW | 3 | 9.50 | 9.1 | 0.18 | 158 | 40 |
| 4 | NaW | 0.5 | PVA | 4 | PEW | 3 | 0.13 | 10.4 | 0.12 | 210 | 36 |
| 5 | NaW | 3 | — | | PEW | 5 | — | 8.2 | 0.21 | 112 | 28 |
| 6 | — | | UR | 3 | PEW | 5 | — | 9.7 | 0.11 | 69 | 20 |
| 7 | Zinc phosphate coating treatment PALBOND ® 181X from Nihon Parkerizing Co., Ltd. (concentration = 90 g/L) Treatment conditions: dipping, 10 minutes, 80° C. | | | | Reactive soap lubrication treatment PALUBE ® 235 from Nihon Parkerizing Co., Ltd. (concentration = 70 g/L) Treatment conditions: dipping, 5 minutes, 80° C. | | Conversion Film Weight: 5.8 Metal Soap Weight: 2.3 Hot-Water Soluble Soap Weight: 2.5 | | 0.10 | 409 | 44 |

TABLE 3

| Examples 18 to 34 | | | | | | | | |
|---|---|---|---|---|---|---|---|---|
| | Components | | | | | | | |
| | Water-Soluble Inorganic Salt | | Synthetic Resin | | Next Dispersate Added | | Final Dispersate Added | |
| Example Number | Material | % by Weight | Material | % by Weight | Material | % by Weight | Material | % by Weight |
| 18 | NaW | 3 | PR | 1 | PEW | 3 | MDS | 2 |
| 19 | NaW | 6 | PR | 1 | PEW | 3 | GP | 2 |
| 20 | NaW | 3 | PVA | 1 | PEW | 3 | BN | 2 |
| 21 | NaW | 7 | PVA | 1 | PEW | 3 | FGP | 2 |
| 22 | NaW | 3 | PVA | 1 | PEW | 3 | SVO | 1 |
| 23 | NaW | 3 | PVA | 1 | PEW | 3 | MoDTC | 1 |
| 24 | NaW | 3 | PVA | 1 | PEW | 3 | MoDTP | 1 |
| 25 | NaMo | 2 | AR | 1 | PEW | 3 | ZnDTP | 1 |
| 26 | KTB | 6 | AR | 1 | PEW | 3 | MDS | 2 |
| 27 | KV | 6 | AR | 1 | PEW | 3 | MDS | 2 |
| 28 | KS | 6 | AR | 1 | PEW | 3 | MDS | 2 |
| 29 | NaTB | 3 | UR | 3 | PEW | 3 | GP | 2 |
| 30 | NaTB | 3 | UR | 3 | PEW | 3 | MDS | 2 |
| 31 | NaTB | 3 | UR | 3 | PEW | 3 | BN | 2 |
| 32 | NaTB | 3 | UR | 3 | PEW | 3 | P3E | 2 |
| 33 | NaTB | 3 | UR | 3 | PEW | 3 | MoDTC | 1 |
| 34 | NaTB | 3 | UR | 3 | PEW | 3 | ZnDTP | 1 |

| | Ratio by Weight of Water-Soluble | | Test Results | | |
|---|---|---|---|---|---|
| | | | Bowden Test | | Backward Punch: |
| Identifying Numbers | Inorganic Salt to Synthetic Resin | Coating Weight, g/m$^2$ | Average Friction Coefficient | Number of Strokes to Seizure | Good Punch Depth, Millimeters |

TABLE 3-continued

| Examples 18 to 34 | | | | | |
|---|---|---|---|---|---|
| 18 | 3.00 | 11.2 | 0.15 | 822 | 48 |
| 19 | 6.00 | 10.6 | 0.12 | 862 | 48 |
| 20 | 3.00 | 11.2 | 0.17 | 685 | 44 |
| 21 | 7.00 | 11.1 | 0.16 | 624 | 44 |
| 22 | 3.00 | 9.8 | 0.11 | 612 | 44 |
| 23 | 3.00 | 9.2 | 0.14 | 741 | 44 |
| 24 | 3.00 | 9.1 | 0.15 | 618 | 44 |
| 25 | 2.00 | 8.2 | 0.11 | 589 | 44 |
| 26 | 6.00 | 11.5 | 0.16 | 854 | 48 |
| 27 | 6.00 | 11.7 | 0.17 | 727 | 48 |
| 28 | 6.00 | 10.7 | 0.16 | 818 | 48 |
| 29 | 1 | 10.3 | 0.12 | 623 | 48 |
| 30 | 1 | 9.2 | 0.11 | 624 | 48 |
| 31 | 1 | 10.3 | 0.12 | 521 | 48 |
| 32 | 1 | 9.3 | 0.08 | 812 | 44 |
| 33 | 1 | 10.8 | 0.10 | 441 | 44 |
| 34 | 1 | 9.3 | 0.08 | 452 | 44 |

What is claimed is:

1. A liquid composition that when dried forms a solid lubricant for the plastic working of metals, said liquid composition comprising water and the following components:

(A) a component of dissolved, dispersed, or both dissolved and dispersed synthetic resin selected from the group consisting of polyvinyl alcohol, Polyvinylpyrrolidone acrylic resins, vinyl acetate resins, epoxy resins, urethane resins, phenolic resins, and mixtures of any two or more of polyvinyl alcohol, polyvinylpyrrolidone, acrylic resins, vinyl acetate resins, epoxy resins, urethane resins, and phenolic resins, (B) a component of dissolved water-soluble inorganic salt and (C) a lubricating agent component selected from the group consisting of metal soaps, waxes, polytetrafluoroethylene, oils, and mixtures of any two or more of metal soaps, waxes, polytetrafluoroethylene and oils, said components (A) and (B) being present in the composition in amounts such that the ratio by weight of component (B) to component (A) is within a range from 0.25:1.0 to 9:1.0 and said component (C) constituting from 1 to 20 percent by weight of the total liquid composition.

2. A liquid composition according to claim 1, wherein the water-soluble inorganic salt is selected from the group consisting of the salts of sulfuric acid, salts of boric acid, salts of molybdic acid, salts of vanadic acid, salts of tungstic acid, and mixtures of any two or more of the salts of sulfuric acid, salts of boric acid, salts of molybdic acid, salts of vanadic acid, and salts of tungstic acid.

3. A liquid composition according to claim 1, wherein:

component (A) comprises urethane resin in an amount from 0.3 to 10.0 percent by weight of the total liquid composition; and component (B) comprises salts of one or more boric acids in an amount from 1.0 to 10.0 percent by weight of the total composition.

4. A lubricant composition according to claim 3 that comprises at least one of the following:

an amount that is from 1 to 20 percent by weight of the total liquid composition of solid lubricant selected from the group consisting of molybdenum disulfide, graphite, boron nitride, mica, fluorinated graphite, and mixtures of any two or more of molybdenum disulfide, graphite, boron nitride, mica, and fluorinated graphite; and an amount that is from 0.5 to 5 percent by weight of the total liquid composition of extreme-pressure additive selected from the group consisting of sulfur-containing extreme-pressure additives, organomolybdenum extreme-pressure additives, phosphorus-containing extreme-pressure additives, chlorine-containing extreme-pressure additives, and mixtures of any two or more of sulfur-containing extreme-pressure additives, organomolybdenum extreme-pressure additives, phosphorus-containing extreme-pressure additives, and chlorine-containing extreme-pressure additives.

5. A liquid composition that can be diluted with water only to produce a composition according to claim 1.

6. A process for preparing a metal object for plastic cold working by providing a solid lubricating coating over said object before cold working is begun, said process comprising operations of:

(I) forming over the surface of the metal object to be cold worked a liquid coating of a composition according to claim 4; and (II) drying the liquid coating formed in operation (I) to form said solid lubricant coating.

7. A process according to claim 6, wherein the solid lubricant coating formed has a coating weight from 5 to 20 $g/m^2$.

8. A lubricant composition according to claim 2 that additionally comprises at least one of the following:

an amount that is from 1 to 20 percent by weight of the total liquid composition of solid lubricant selected from the group consisting of molybdenum disulfide, graphite, boron nitride, mica, fluorinated graphite, and mixtures of any two or more of molybdenum disulfide, graphite, boron nitride, mica, and fluorinated graphite; and an amount that is from 0.5 to 5 percent by weight of the total liquid composition of extreme-pressure additive selected from the group consisting of sulfur-containing extreme-pressure additives, organomolybdenum extreme-pressure additives, phosphorus-containing extreme-pressure additives, chlorine-containing extreme-pressure additives, and mixtures of any two or more of sulfur-containing extreme-pressure additives, organomolybdenum extreme-pressure additives, phosphorus-containing extreme-pressure additives, and chlorine-containing extreme-pressure additives.

9. A process for preparing a metal object for plastic cold working by providing a solid lubricating coating over said object before cold working is begun, said process comprising operations of:

(I) forming over the surface of the metal object to be cold worked a liquid coating of a composition according to claim 8; and (II) drying the liquid coating formed in operation (I) to form said solid lubricant coating.

10. A process according to claim 9, wherein the solid lubricant coating formed has a coating weight from 5 to 20 $g/m^2$.

11. A lubricant composition according to claim 1 that additionally comprises at least one of the following:

an amount that is from 1 to 20 percent by weight of the total liquid composition of solid lubricant selected from the group consisting of molybdenum disulfide, graphite, boron nitride, mica, fluorinated graphite, and mixtures of any two or more of molybdenum disulfide, graphite, boron nitride, mica, and fluorinated graphite; and an amount that is from 0.5 to 5 percent by weight of the total liquid composition of extreme-pressure additive selected from the group consisting of sulfur-containing extreme-pressure additives, organomolybdenum extreme-pressure additives, phosphorus-containing extreme-pressure additives, chlorine-containing extreme-pressure additives, and mixtures of any two or more of sulfur-containing extreme-pressure additives, organomolybdenum extreme-pressure additives, phosphorus-containing extreme-pressure additives, and chlorine-containing extreme-pressure additives.

12. A process for preparing a metal object for plastic cold working by providing a solid lubricating coating over said object before cold working is begun, said process comprising operations of:

(I) forming over the surface of the metal object to be cold worked a liquid coating of a composition according to claim 11; and (II) drying the liquid coating formed in operation (I) to form said solid lubricant coating.

13. A process according to claim 12, wherein the solid lubricant coating formed has a coating weight from 5 to 20 $g/m^2$.

14. A process for preparing a metal object for plastic cold working by providing a solid lubricating coating over said object before cold working is begun, said process comprising operations of:

(I) forming over the surface of the metal object to be cold worked a liquid coating of a composition according to claim 3; and (II) drying the liquid coating formed in operation (I) to form said solid lubricant coating.

15. A process according to claim 14, wherein the solid lubricant coating formed has a coating weight from 5 to 20 $g/m^2$.

16. A process for preparing a metal object for plastic cold working by providing a solid lubricating coating over said object before cold working is begun, said process comprising operations of:

(I) forming over the surface of the metal object to be cold worked a liquid coating of a composition according to claim 2; and (II) drying the liquid coating formed in operation (I) to form said solid lubricant coating.

17. A process according to claim 16, wherein the solid lubricant coating formed has a coating weight from 5 to 20 $g/m^2$.

18. A process for preparing a metal object for plastic cold working by providing a solid lubricating coating over said object before cold working is begun, said process comprising operations of:

(I) forming over the surface of the metal object to be cold worked a liquid coating of a composition according to claim 1; and (II) drying the liquid coating formed in operation (I) to form said solid lubricant coating.

19. A process according to claims 18, wherein the solid lubricant coating formed has a coating weight from 5 to 20 $g/m^2$.

* * * * *

UNITED STATES PATENT AND TRADEMARK OFFICE

CERTIFICATE OF CORRECTION

PATENT NO. : 6,455,476 B1
DATED : September 24, 2002
INVENTOR(S) : Imai et al.

It is certified that error appears in the above-identified patent and that said Letters Patent is hereby corrected as shown below:

Column 17,
Line 29, after “rolidone” and before “acrylic”, insert therefor -- , --.
Line 34, after “resins” and before “(B) a component”, delete “,” and insert therefor -- ; --.
Line 35, after “inorganic salt”, insert thererfor -- ; --.

Column 20,
Line 40, delete “claims” and insert therefor -- claim --.

Signed and Sealed this

Fifth Day of August, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,455,476 B1 
APPLICATION NO. : 09/719065
DATED : September 24, 2002
INVENTOR(S) : Imai et al.

It is certified that error appears in the above-identified patent and that said Letters Patent is hereby corrected as shown below:

Column 3, line 21 through line 31, delete the entire paragraph starting with "BRIEF DESCRIPTION OF THE DRAWINGS" and ending with "...being punched".

<u>Column 11</u>
Line 41, delete ", four of which are illustrated in drawing FIGS. 2a through 2d".
Line 62, delete "2 in FIG. 1".
Line 64, delete "1 as illustrated in FIG.1".
Line 65 through Line 66, delete "3 also shown in FIG.1".
Line 67, delete "1".

Column 12, line 1 through line 2, delete "as shown in FIGS. 3a through 3b".

Signed and Sealed this

Sixth Day of November, 2007

JON W. DUDAS
*Director of the United States Patent and Trademark Office*